US005405001A

United States Patent [19]

Lillard

[11] Patent Number: 5,405,001

[45] Date of Patent: Apr. 11, 1995

[54] REMOVABLE AND PIERCEABLE ACTIVATION CLOSURE FOR TWO-COMPARTMENT VIAL

[75] Inventor: Jeffrey L. Lillard, Santa Ana, Calif.

[73] Assignee: Clinetics Corporation, Tustin, Calif.

[21] Appl. No.: 235,551

[22] Filed: Apr. 29, 1994

[51] Int. Cl.[6] ..... B65D 25/08

[52] U.S. Cl. ..... 206/221; 220/212; 220/306; 220/315; 215/DIG. 8

[58] Field of Search ..... 206/219, 221; 215/6, 215/DIG. 8, 354, 355, 320; 220/212, 306, 307, 315

[56] References Cited

U.S. PATENT DOCUMENTS

| | | | |
|---|---|---|---|
| 4,089,432 | 5/1978 | Crankshaw et al. | 215/6 |
| 4,180,173 | 12/1979 | Diaz | 215/6 |
| 4,194,640 | 3/1980 | Crankshaw et al. | 215/6 |
| 4,267,925 | 5/1981 | Crankshaw et al. | 206/221 |
| 4,274,543 | 6/1981 | Braymer, Jr. et al. | 215/6 |
| 4,331,233 | 5/1982 | Braymer, Jr. | 206/221 |
| 4,727,985 | 3/1988 | McNeirney et al. | 215/DIG. 8 X |
| 4,779,722 | 10/1988 | Hall | 206/219 |
| 5,291,991 | 3/1994 | Meyer | 206/221 |

*Primary Examiner*—Jacob K. Ackun, Jr.
*Attorney, Agent, or Firm*—Klein & Szekeres

[57] ABSTRACT

A closure structure or cap for a two compartment vial includes a resilient stopper having a cylindrical body with a lower shoulder portion adapted for sealing fit in the mouth of the vial and a second circumferential shoulder at is upper end. A substantially rigid hollow cylindrical sleeve is configured to surround the mouth of the vial, and has, at its upper end, integrally constructed downwardly projecting longitudinally split fingers dimensioned to embrace the stopper, with the bottoms of the split fingers engaging and resting upon the lower shoulder portion of the rubber stopper. An internal groove in the split fingers engages the lower edge of a second shoulder of the stopper thereby gripping the stopper. A locking member is disposed between the longitudinally split fingers and the inside walls of the hollow cylindrical sleeve or cap, forming means to prevent spreading of the fingers and thereby preventing the loosening of the grip of the fingers on the stopper. The cylindrical sleeve is of such length that its lower end extends below the bottom of the stopper, whereby when the closure is removed from the vial and is placed on a support surface only the lower end of the sleeve rests on the surface. Optionally, the locking member includes a frangible tab which, after removal exposes the upper surface of the resilient stopper for puncturing with a hypodermic needle, thereby permitting removal of liquid from the vial with a needle and syringe.

21 Claims, 4 Drawing Sheets

REMOVABLE AND PIERCEABLE ACTIVATION CLOSURE FOR TWO-COMPARTMENT VIAL

BACKGROUND OF THE INVENTION

1. Field of the Invention

The present invention is in the field of activation closures for vials. More particularly, the present invention is directed to an activation closure cap for a two-compartment vial which has improved control over the stopper, permits removal of the closure cap and subsequent recapping of the vial without significant risk of contamination of the contents, of the environment and the user, and which optionally also allows access to contents of the vial by piercing the closure with a hypodermic needle.

2. Brief Description of the Prior Art

Two-compartment vials have been known in the art for a long time and are presently in widespread use. The two compartments of such vials are typically separated by a neck portion which has an internal stopper or plug. The plug forms an efficient liquid seal between the two compartments. Each compartment contains a substance which, for some reason, should not be brought into contact with the substance in the other compartment before use, that is, while the vial and its contents are in transit and storage. A closure cap (or simply closure) seals the upper compartment of the two-compartment vial. However, in order to permit contact between the two substances in the two separate compartments of the vial when such contact becomes desirable, the closure cap provides means for dislodging the internal stopper or plug from the intermediate neck portion of the vial, and thereby allows the substances in the two compartments to mix. The upper compartment contains a liquid, and the closure cap includes a rubber stopper which, when pressed in a downwardly direction creates sufficient hydrostatic pressure on the liquid to dislodge the internal stopper, cause it to fall into the lower compartment and thereby remove the internal stopper from between the two compartments.

The above-summarized two-compartment vials are widely used in connection with medication of the type wherein two (or more) components need to be mixed just before administration to a patient. Typically in such application the lower compartment contains a lyophilized powder (of an antibiotic, for example) and the upper compartment contains a diluent solution in which the lyophilized powder is to be dissolved before injection to a patient. Such medication, of course, needs to be sterile. Therefore, after mixing or "reconstituting" the sterile medication, it is withdrawn from the vial by piercing the rubber stopper of the closure member with a hypodermic needle attached to a syringe. The closure member or cap for such a vial is sometimes called an "activation closure", because the step of dislodging the internal stopper or plug (thereby allowing the components of the two compartments to mix) activates the contents. U.S. Pat. No. 4,331,233 describes a two-compartment vial with an activation closure which greatly reduces the possibility of inadvertently pushing the rubber stopper of the closure too far into the compartments. The closure cap of this reference patent also permits efficient withdrawal of the contents of the vial with a hypodermic syringe and needle.

Vials are also used in diagnostic and like medical laboratory applications, where the "activated" contents of the vial do not comprise medications (such as parenterial injections for humans or animals) but rather where the contents are utilized as a reagent or "standard" in diagnostic and like tests. For example, all licensed medical laboratories in the United States of America are required to use certain control serums in connection with laboratory tests of human blood serum. Typically, the solid lyophilized control serum is provided in accordance with the art in a single compartment vial equipped with a pierceable stopper or closure member, to which purified water (or other suitable diluent) is added before use. A disadvantage of the latter single compartment vial is that it introduces the possibility of human error with regards to the identity, quantity and quality of the diluent which is added to the lyophilized control serum.

In such diagnostic or laboratory application however, it is usually desirable to extract only an aliquot portion of the sample solution (standard or control serum) which is formed after activation. Typically, the sample solution (standard or control serum) is stored for a long time in refrigerated condition, and further aliquot portions are withdrawn from time-to-time until the solution is used up. The aliquot portions or samples can be withdrawn with a hypodermic needle and syringe by piercing a rubber stopper in the closure member. However, because of the inherent danger from needle sticks, laboratory personnel typically prefer to remove the closure member altogether, and extract a sample from the temporarily uncapped vial with a pipette (or the like). Both of these procedures in accordance with the above-summarized prior art have their disadvantages. Removal of the closure cap of a vacuum packed lyophilized vial before a diluent is added raises the possibility of aerosol formation and the use of hypodermic syringe and needle raises the possibility of accidental pricking of laboratory personnel, which in view of acquired immunodeficiency syndrome and other diseases transmitted through blood or serum, is to be strictly avoided. Removing the closure member from the neck of the vial in order to permit withdrawal of a portion with a pipette (or the like) raises the danger of contaminating both the sample, the work environment and the laboratory worker. This is because the closure member must be typically placed on a support surface such as a laboratory table, where the rubber stopper actually touches the surface with the possibility of leaving traces of the vial's contents behind, and also with the possibility of the stopper picking up impurities from the support surface and introducing it into the sample.

In addition to the foregoing operational problems, the art pertaining to closure members for two-compartment vials and the like, is also burdened with problems of more technical nature, such as the fact that glass vials cannot be mass produced inexpensively with very tight tolerances, the need for perfect or nearly perfect liquid internal seals for the vials, the need for avoiding inadvertently pushing the rubber stopper too far into the upper compartment when the contents of the two-compartment vial are activated, and the need for avoiding, as much as possible, frangible metal members which may have sharp edges capable of inflicting injury to laboratory personnel.

U.S. Pat. Nos. 4,089,432, 4,180,173, 4,267,925, 4,274,543, and 4,194,640 describe various closure structures of the prior art which attempt to solve one or more of the above noted problems. Nevertheless, there is still a need in the art for improvements in two-compartment vial closures, especially for laboratory and diagnostic applications. The present invention fills this need.

SUMMARY OF THE INVENTION

It is an object of the present invention to provide an activation closer structure for a two-compartment vial which can be readily removed and replaced on the vial to permit removal of a portion or the entire contents of the vial.

It is another object of the present invention to provide an activation closer structure for a two-compartment vial which can be placed on a support surface while it is temporarily removed from the vial, without significant risk of contaminating laboratory personnel, the support surface or the contents of the vial.

It is still another object of the present invention to provide an activation closer structure for a two-compartment vial which, can be temporarily removed from the vial to permit access to contents of the vial, and which also allows access to contents of the vial with a hypodermic needle and syringe.

It is yet another object of the present invention to provide an activation closure structure for a two-compartment vial, the use of which eliminates formation of aerosols from the vial which can contaminate the environment and the user.

The foregoing and other objects and advantages are attained by a closure structure or cap for a two compartment vial which includes a resilient stopper having a cylindrical body with a lower shoulder portion adapted for sealing the mouth of the vial and a second circumferential shoulder at its upper end. A substantially rigid hollow cylindrical sleeve is configured to surround the mouth of the vial, and has, at its upper end, integrally constructed downwardly projecting longitudinally split fingers dimensioned to embrace the resilient stopper, with the bottoms of the split fingers engaging and resting upon the lower shoulder portion of the resilient stopper. An internal groove in the split fingers engages the lower edge of second shoulder of the resilient stopper thereby gripping the resilient stopper and allowing the stopper to be pulled from the mouth of the vial. A locking member is disposed between the longitudinally split fingers and the inside walls of the hollow cylindrical sleeve or cap, forming means to prevent spreading of the fingers and thereby preventing the loosening of the grip of the fingers on the stopper. The cylindrical sleeve is of such length that its lower end extends below the bottom of the stopper, whereby when the closure is removed from the vial and is placed on a support surface only the lower end of the sleeve rests on the surface and the resilient stopper cannot come into contact with the work surface. Optionally, the locking member includes a frangible tab which, after removal exposes the upper surface of the stopper for puncturing with a hypodermic needle, thereby permitting addition or removal of liquid from the vial with a needle and syringe.

The features of the present invention can be best understood together with further objects and advantages by reference to the following description, taken in connection with the accompanying drawings, wherein like numerals indicate like parts.

DESCRIPTION OF THE PREFERRED EMBODIMENT

Figure 1:
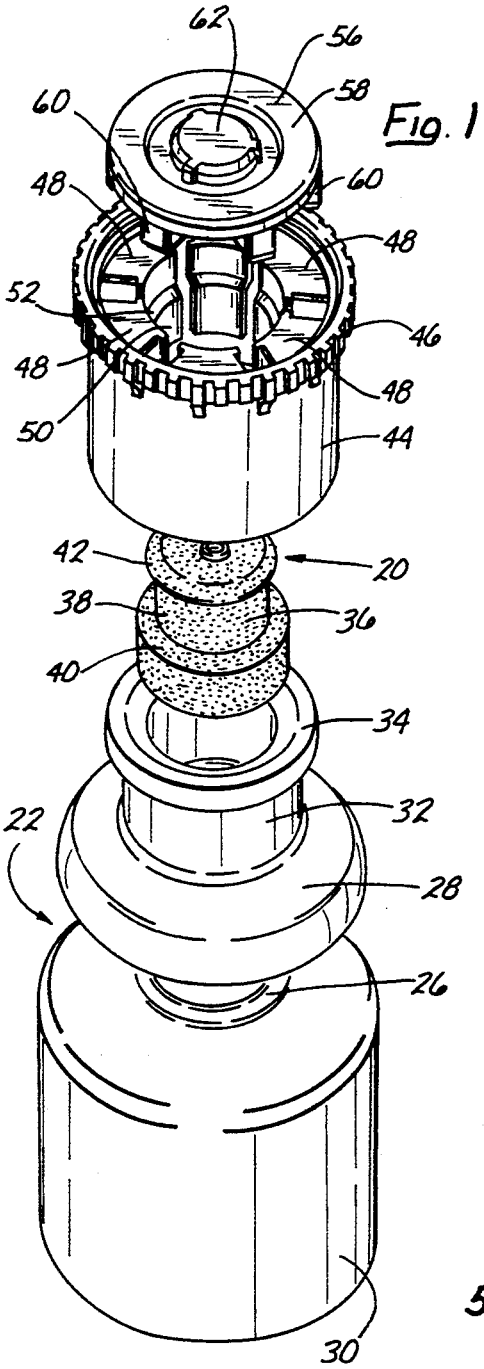
FIG. 1 is an exploded perspective view of the activation closure for a two-compartment vial of the present invention, the view, partially showing the two-compartment vial.
Figure 2:
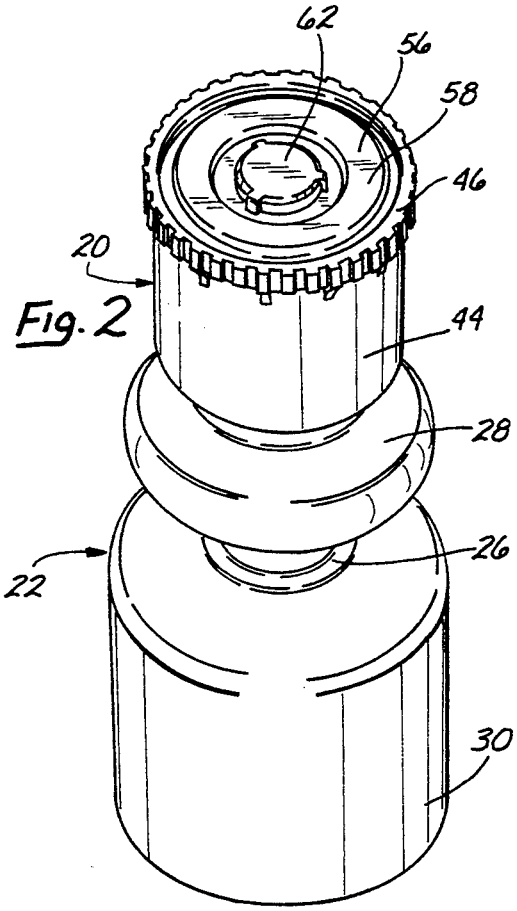
FIG. 2 is a perspective view of the activation closure cap fitted to a two-compartment vial of the present invention.
Figure 3:
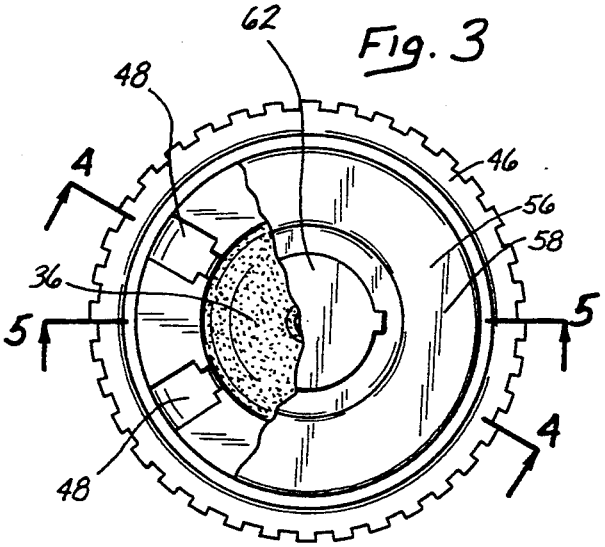
FIG. 3 is a top view of the activation closure cap for a two-compartment vial of the present invention, with part of a locking member broken away.

The following specification taken in conjunction with the drawings sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Referring now to the drawing figures, and particularly to FIGS. 1–6, the preferred embodiment of activation vial closure cap (closure cap) 20 of the present invention is disclosed. It should be noted at the outset, that the closure cap 20 of the present invention is designed to function primarily for sealing or closing a two-compartment vial 22 of the type which has an internal stopper or plug 24 disposed in an intermediate narrow neck 26 that separates the vial 22 into an upper 28 and a lower compartment 30. Above the upper compartment 28 of the vial 22 there is a mouth portion 32 which is cylindrical and of smaller diameter then the upper compartment 28. The mouth portion 32 includes an outer circumferential rim or lip 34. The vial 22 is mass produced in accordance with the state-of-the-art, from glass. The internal stopper or plug 24 is a cylindrical body comprising medicinal quality rubber. Such two-compartment vials 22 are well known in the art, and are described, for example, in U.S. Pat. No. 4,331,233 in connection with the description of an activation closure cap disclosed in that patent. As it was noted above in the introductory section of the present patent application, two-compartment vials are utilized when the components of a medicinal agent (such as an injection, or less frequently oral medication) or components of a diagnostic or analytical standard or reagent are to be kept separate during transportation and storage, and to brought into contact with one another only before administration or use. Certain antibiotics which are to be reconstituted (dissolved) with physiological saline or glucose solution only before administration, serve as examples for requiring the use of two-compartment vials in the medical treatment field. Standard or control serum samples, to be dissolved in purified water or some other diluent before use, serve as examples for requiring the use of two-compartment vials in medical and diagnostic laboratory applications. The improved activation closure cap of the present invention is equally suitable for use in both applications, although its presently intended primary use is in the diagnostic or laboratory applications, primarily for storing and handling control serums, standards or reagents.

Referring back again now primarily to FIGS. 1–6, the closure cap of 20 of the present invention includes a top stopper 36 which has a substantially cylindrical main body 38, a lower substantially cylindrical shoulder portion 40, and an upper circumferential shoulder 42. The stopper 36 is made from an elastic material, preferably of medicinal grade rubber. The lower shoulder 40 of the stopper 36 is dimensioned to fit tightly within the mouth 32 of the vial 22 so as to form an efficient fluid seal therein. This is well shown in the cross-sectional views of FIGS. 4 and 5. As it was noted above, mass produced glass vials of the type with which the closure cap of the present invention is used are not manufactured with tight tolerances, however the rubber employed in the stopper 36 is sufficiently elastic and the shoulder 40 is made sufficiently oversized so as to form an efficient seal in the mouth A second major component of the closure cap 20 of the present invention is a substantially cylindrical hollow sleeve 44 which is configured to surround the mouth 32 and rim 34 of the vial 22. The sleeve 44 has an upper peripheral rim 46 which is knurled to make it easier for a human (not shown) to firmly hold and manipulate the closure cap 20. In the interior of the upper portion of the sleeve 44 there are a plurality of radially disposed inwardly projecting tabs 48 to which downwardly projecting substantially axially disposed fingers 50 are attached. The tabs 48 and the fingers 50 are integrally constructed with the sleeve 44, which can be made from several suitable medicinal grade plastic materials known in the art. In the herein described preferred embodiment the sleeve 44 comprises polypropylene, and is formed by plastic injection molding. The tabs 48 and the fingers 50 in effect form, within the interior of the sleeve 44, another cylinder concentric with the outer sleeve 44 but of smaller diameter and having split walls. The interior wall of the cylinder formed by the split fingers 50 includes step-down or dog-leg portion thus forming a shoulder 52. A circumferential rib on the exterior of the split fingers 50 also forms a shoulder 54.

The diameter and length of the cylinder formed from the split fingers 50 is such that the lower portion of the cylinder fits within the mouth 32 of the vial 22, and that in the assembled structure the bottom of the fingers 50 rests on the lower shoulder 40 of the rubber stopper 36. The fingers 50 surround and engage the main body 38 of the stopper 36, whereas the shoulder 52 formed in the step-down or dog leg portion of the fingers 50 engages the upper shoulder 42 of the stopper 36. These features are well shown in FIGS. 4, 5 and 11.

Figure 4:
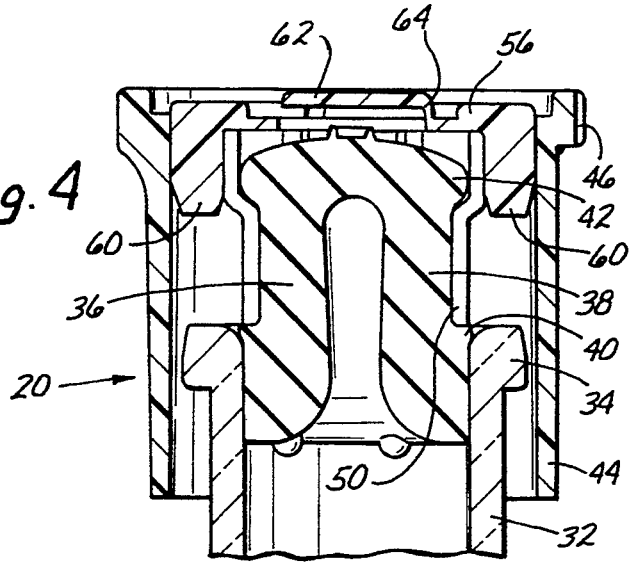
FIG. 4 is a cross-sectional view taken on lines 4,4 of FIG. 3.
Figure 5:
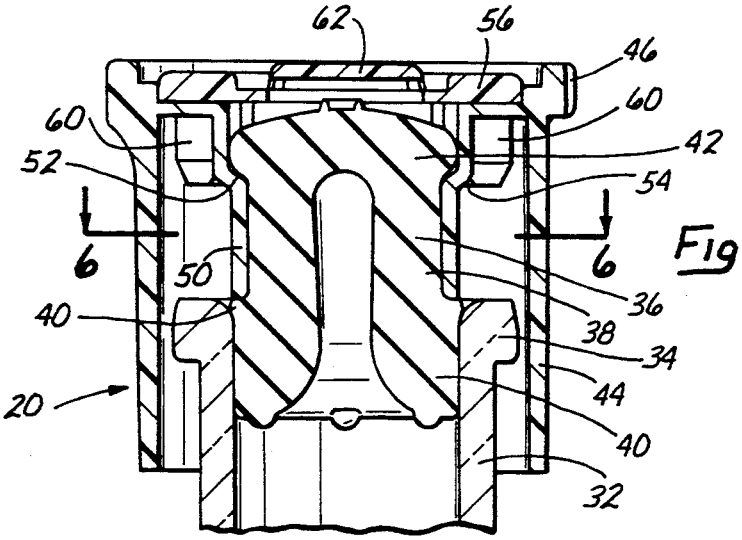
FIG. 5 is a cross-sectional view taken on lines 5,5 of FIG. 3.
Figure 6:
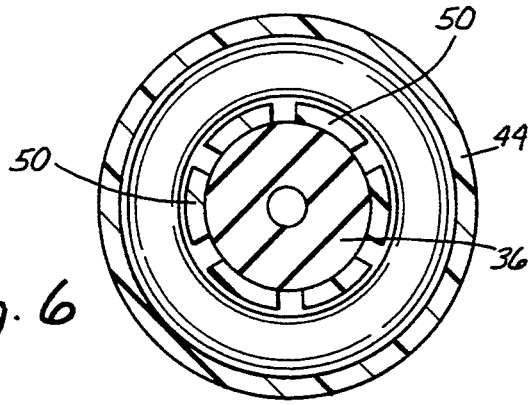
FIG. 6 is a cross-sectional view taken on lines 6,6 of FIG. 5.

A third major component of the closure cap 20 of the present invention is a locking member 56 which has a flat disk-like body 58. Substantially evenly spaced along its circumference there are a plurality of downwardly projecting spikes 60. The disk-like body 58 is configured to fit within the top of the sleeve 44, in effect acting as a cover for the same. The spikes 60 are configured for insertion into the spaces formed between the tabs 48, to provide a tight fit in the annular space formed between the split fingers 50 and the interior wall of the sleeve 44 and to abut the exterior shoulder 54 of the fingers 50. The exploded perspective view of FIG. 1 shows the locking member 56 in detail before it is assembled to the sleeve 44. The cross-sectional views of FIGS. 4 and 5 show the locking member 56 assembled to the sleeve 44 such that the split fingers 50 are firmly held in position and prevented from spreading outwardly. As a result the split fingers 50 are prevented from releasing their grip on the rubber stopper 36, and the plastic sleeve 44 and locking member 56 assembly cannot slip off the rubber stopper 36 when one removes the closure cap 20 from the vial 22. Optionally, as in the herein described preferred embodiment, the locking member 56 includes a round tab 62 forming the center of the disk-like body 58, and therefore a cover above the rubber stopper 36. The round tab 62 is attached to the locking member 56 through a frangible, weak portion 64, so that it can be readily torn off, thereby exposing the rubber stopper 36.

Figure 9:
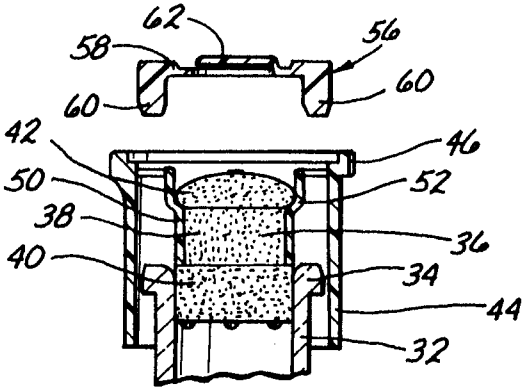
FIG. 9 is a schematic view partly in cross-section, showing still another step in the assembly of the activation closure cap of the present invention to a two-compartment vial, with part of the vial broken away.
Figure 8:
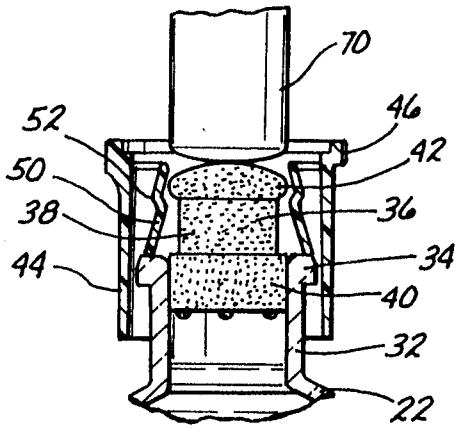
FIG. 8 is a schematic view partly in cross-section, showing another step in the assembly of the activation closure cap of the present invention to a two-compartment vial, with part of the vial broken away.
Figure 10:
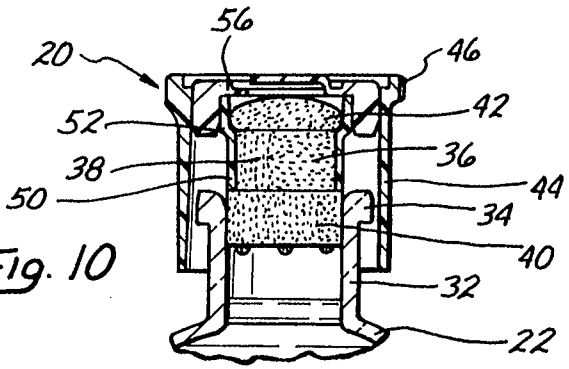
FIG. 10 is a schematic view partly in cross-section, showing the activation closure cap of the present invention assembled to a two-compartment vial in a first position where the two compartments of the vial are sealed from each other, with part of the vial broken away.
Figure 7:
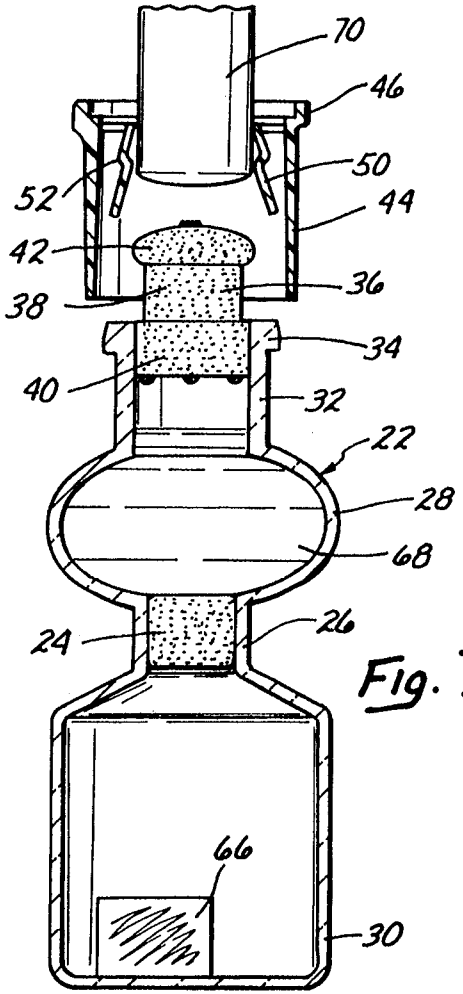
FIG. 7 is a schematic view partly in cross-section, showing a step in the assembly of the activation closure cap of the present invention to a two-compartment vial.
Figure 11:
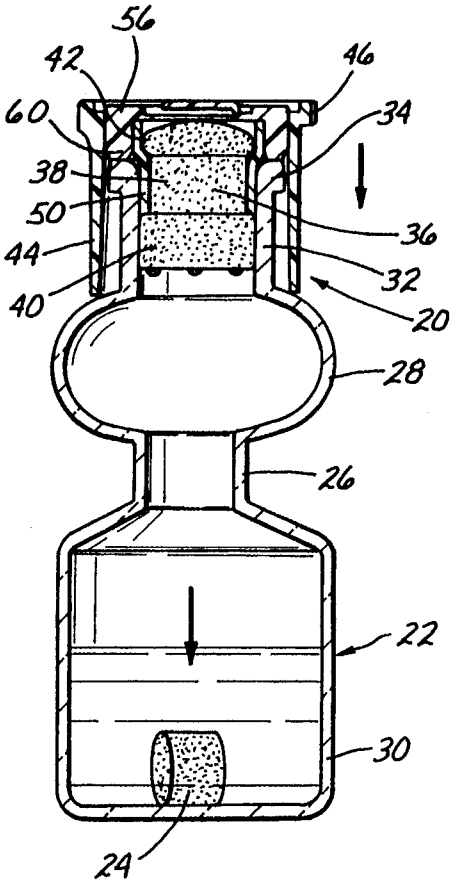
FIG. 11 is a schematic view partly in cross-section, showing the activation closure cap of the present invention assembled to a two-compartment vial in a second position where the two compartments of the vial are no longer sealed from each other.

FIGS. 7 through 14 disclose the preferred method of assembling the closure cap 20 of the present invention to a two-compartment vial 22, and disclose the manner in which the closure cap 20 is advantageously utilized. Thus, the schematic view of FIG. 7 shows a two-compartment vial 22 having, in its lower compartment 30 a solid material 66 (such as a lyophilized control serum). In its upper compartment 28 the vial 22 has a liquid material 68 (such as physiological saline solution) in which the solid 66 is to be dissolved or reconstituted with, before use. The two compartments are separated by the plug 24. The solid material 66, plug 24 and the liquid material 68 are placed into the vial 22 in accordance with the state-of-the-art. The lower shoulder 40 of the rubber stopper 36 is also inserted into the mouth 32 of the vial 22 while the rest of the stopper 36 is still disposed outside of the vial 22. As is still further shown in FIG. 7, the sleeve 44 is placed on the stopper 36 with the use of a tool (schematically shown as 70) the primary function of which is to spread the split fingers 50 while the sleeve 44 is placed around the lip 34 of the vial 22. FIG. 8 shows the sleeve 44 assembled to the rubber stopper 36 as the tool 70 is being withdrawn and the fingers 50 are in the process of springing back to their normal position where they grab the rubber stopper 36. FIG. 9 shows the sleeve 44 fully assembled to the stopper 36 and ready to receive the locking member 56. FIG. 10 be shows the locking member 56 mounted to the sleeve 44, thereby completing assembly of the closure cap 20. FIG. 10 be shows the closure cap 20 in that position on the vial 22 in which the two compartments 28 and 30 of the vial 22 are sealed from each other. This is the position in which two-compartment vials containing medication or diagnostic reagents or standards are normally shipped and stored. It will be readily appreciated by those skilled in the art, that when substantial pressure is exerted in a downwardly direction on the closure cap 20, then the resulting hydrostatic pressure on the liquid 68 causes the plug 24 to become dislodged from the neck 26 thereby allowing the components of the two compartments 28 and 30 to mix. The cap 20 moves downward on the mouth 32 of the vial 22 to occupy a second position. The schematic view of FIG. 11 shows the closure cap 20 on the vial 22 in the second position. As this figure reveals, after the components are mixed, the bottom ends of the spikes 60 of the locking member 56 abut the lip 34 of the mouth 32 of the vial 22, and thereby provide a positive tactile sensation and indication to a person that the closure cap 20 had been sufficiently moved to accomplish mixing of the components in the two compartments. It should also be readily apparent to those skilled in the art from the foregoing description, that the plastic fingers 50 resting on the lower shoulder 40 of the stopper 36 firmly transmit the downward directed force to the stopper 36 while they prevent bulging of the main body portion 38 of the stopper 36.

Figure 12:
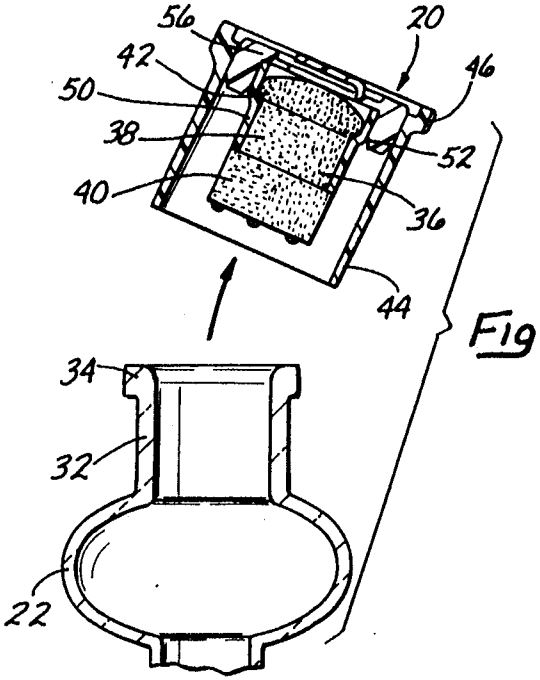
FIG. 12 is a schematic view partly in cross-section, showing the activation closure cap of the present invention removed from a two-compartment vial, with part of the vial broken away.

FIG. 12 shows the closure cap 20 after it has been removed from the mouth 32 of the vial 22. This is done when it is desired to access the contents of the vial 22 by means other than a hypodermic needle, such as for example when one wishes to remove an aliquot portion of the contents with a pipette (not shown) or like instrument. It should be readily apparent based on the foregoing description and from the drawing figures, that the rubber stopper 36 is firmly gripped within the sleeve 44 by the fingers 50, which, due to the locking member, cannot spread outwardly and slip-off the rubber stopper 36 while the closure cap 20 is pulled away from the vial 22. It is believed that the ability to remove the closure cap 20 from the vial 22 is a novel feature which provides a significant advantage over the state-of-the-art in the field of two-compartment vials. Whereas the above described specific embodiment is the presently contemplated best mode for firmly gripping the rubber stopper 36 and allows the ability to both firmly push down on the stopper 36 to dislodge the plug 24 and to remove the closure cap 20 from the vial 22, various other structures and means are possible for accomplishing the foregoing. For example, the rubber stopper 36 may be provided with threads (not shown) which can be engaged and firmly held by complementary threads (not shown) in the interior of the sleeve.

Figure 14:
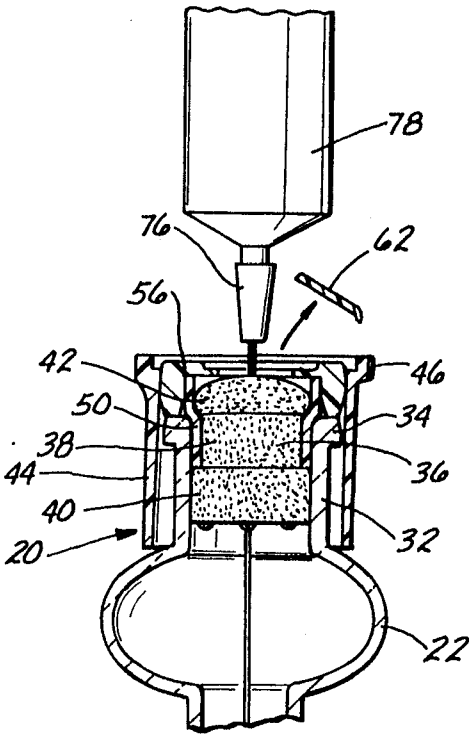
FIG. 14 is a schematic view partly in cross-section, showing access to contents of the two-compartment vial with a hypodermic needle and syringe combination by piercing through the activation closure cap of the present invention.
Figure 13:
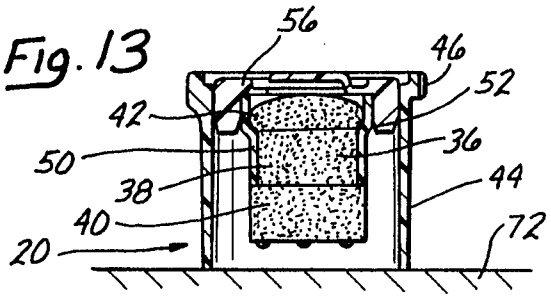
FIG. 13 is a schematic view partly in cross-section, showing the activation closure cap of the present invention placed to rest on a support surface.

FIG. 13 shows the closure cap 20 placed on a support surface. 72, such as a laboratory table. As is shown in the drawings, the sleeve 44 is of such length that it extends below the bottom of the stopper 36, so that drops (not shown) of liquid which may be retained on the bottom of the stopper 36 do not touch and contaminate the support surface 72. Nor does the support surface 72 touch the stopper 36 and therefore the stopper 36 does not pick up impurities from the support surface 72 to contaminate the vial 22 after recapping. Perhaps even more importantly laboratory personnel (not shown) are unlikely to come into contact with the liquid retained on the bottom of the stopper 36 thereby avoiding a major health risk. FIG. 14 shows an alternative use of the closure cap 20 of the present invention, where the frangibly attached tab 62 is removed, discarded, and contents of the vial 22 are accessed with a hypodermic needle 76 and syringe 78 combination.

The closure cap assembly of the present invention thus greatly facilitates the use of two-compartment vials in medical laboratory, diagnostic and like applications where the ability to safely remove and replace the closure, without danger of contamination, is particularly important. The closure cap of the present invention can also advantageously replace closure caps in single compartment vials in the laboratory and diagnostic fields, in situations where the vial contains a powder or other solid material which is to be dissolved in a liquid or solution just before use. In these situations, in accordance with the prior art, laboratory personnel are required to add the appropriate liquid or solution in precisely the correct quantity. Because, the closure cap of the present invention is easily removable and replaceable, using a two-compartment vial having the closure cap of the present invention, and the factory selected and metered liquid or solution offers a distinct advantage over the prior art.

Further advantages and several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. In combination a two-compartment vial having a lower first compartment and an upper second compartment, said compartments being separated from each other with a neck portion having a plug which acts as a dislodgeable seal, and a mouth portion above the second compartment, and an activation closure cap which comprises:

a resilient stopper having a substantially cylindrical main body, a first lower shoulder portion concentric with the main body and dimensioned to sealingly fit within the mouth of the vial, and a second upper shoulder portion concentric with the main body;

a hollow substantially cylindrical sleeve of larger diameter than the mouth of the vial, configured to be placed around the mouth of the vial, the sleeve including a plurality of fingers disposed substantially axially within its interior, an annular space being formed between the fingers and the inner wall of the cylindrical sleeve, the fingers forming a cylinder with split walls and dimensioned to receive the upper shoulder and the main body of the stopper in a configuration where the lower ends of the fingers abut the lower shoulder of the stopper, and locking means attached to the sleeve for preventing the fingers from spreading outwardly into the annular space, thereby causing the fingers to firmly grip the resilient stopper, the sleeve being of such dimension that it extends below the bottom of the resilient stopper when the stopper is gripped in the fingers, whereby the activation closure cap can be removed from the vial without leaving the stopper in the mouth of the vial, and whereby when the closure cap is removed from the vial and placed on a flat support surface only the bottom of the sleeve touches the support surface.

2. The combination of claim 1 wherein the stopper comprises medicinal grade rubber.

3. The combination of claim 1 wherein the sleeve further includes within its interior a plurality of circumferentially spaced radially inwardly pointing tabs, and wherein each finger is attached to one of the tabs.

4. The combination of claim 1 wherein each finger has a step-down portion, said step-down portions forming means for engaging the upper shoulder of the resilient stopper.

5. The combination of claim 1 wherein the locking means comprise a disk having a plurality of downwardly projecting spikes configured to tightly fit in the annular space between the fingers and the interior wall of the sleeve.

6. The combination of claim 1 wherein the locking means comprise a disk having a plurality of downwardly projecting spikes configured to tightly fit in the annular space between the fingers and the interior wall of the sleeve, a center portion of the disk being disposed above the resilient stopper and being frangibly attached to the disk so that when the frangible portion is severed the center portion is removed and the top of the resilient stopper is exposed.

7. The combination of claim 6 wherein the locking means and the sleeve are dimensioned such in relation to the vial that the lower end of the spikes abutting the mouth of the vial comprise the lower limit of travel of the closure cap downward on the vial.

8. The combination of claim 1 wherein the sleeve and the fingers comprise one unitary piece.

9. In combination a two-compartment vial having a lower first compartment and an upper second compartment, said compartments being separated from each other with a neck portion narrower than either of the first and second compartments and having a plug which acts as a dislodgeable seal, and a mouth portion above the second compartment concentric with and narrower than the second compartment, and an activation closure cap which comprises:

a resilient stopper having a substantially cylindrical main body, a first lower shoulder portion larger in diameter than and concentric with the main body and dimensioned to sealingly fit within the mouth of the vial, and a second upper shoulder portion larger in diameter than and concentric with the main body;

a hollow substantially cylindrical sleeve of larger diameter than the mouth of the vial, configured to fit about the mouth of the vial, the sleeve including a plurality of fingers disposed substantially axially within its interior, an annular space being formed between the fingers and the inner wall of the cylindrical sleeve, the fingers forming a cylinder with split walls dimensioned to receive and hold the upper shoulder and the main body of the stopper in a configuration where the fingers are juxtaposed to the upper shoulder and to the main body of the stopper and the lower ends of the fingers abut the lower shoulder of the stopper, and locking means attached to the sleeve for preventing the fingers from spreading outwardly into the annular space, thereby causing the fingers to firmly grip the resilient stopper, the sleeve being of such dimension that it extends below the bottom of the resilient stopper when the stopper is held in the fingers.

10. The combination of claim 9 wherein the stopper comprises medicinal grade rubber.

11. The combination of claim 10 wherein the sleeve further includes within its interior a plurality of circumferentially spaced radially inwardly pointing tabs, and wherein each finger is attached to one of the tabs.

12. The combination of claim 11 wherein each finger has a step down portion, said step down portions forming means for engaging the upper shoulder of the resilient stopper.

13. The combination of claim 12 wherein the locking means comprise a disk having a plurality of downwardly projecting spikes configured to tightly fit in the annular space between the fingers and the interior wall of the sleeve.

14. The combination of claim 13 wherein the disk of the locking means includes a center portion disposed above the resilient stopper and being frangibly attached to the disk so that when the frangible portion is severed the center portion is removed and the top of the resilient stopper is exposed.

15. The combination of claim 14 wherein the sleeve and the fingers comprise one unitary piece.

16. An activation closure cap in combination with a two compartment vial adapted to seal the two-compartment vial of the type having a lower first compartment and an upper second compartment, said compartments being separated from each other with a neck portion having a plug which acts as a dislodgeable seal, and a mouth portion above the second compartment, the closure cap comprising:

a resilient stopper configured to fit within and seal the mouth of the vial;

a hollow cylindrical sleeve configured to fit around the mouth of the vial and capable of being moved in the ordinary course of operating the combination, within limits, axially down on the mouth of the vial and without limit axially up on the vial whereby pressure can be exerted on liquid contained in the upper compartment by pushing the closure cap downward on the vial to dislodge the plug, the sleeve including means for firmly gripping the resilient stopper while the sleeve moves axially UP on the mouth of the vial and for carrying the stopper with the sleeve, whereby the closure cap including the resilient stopper can be removed from the vial.

17. The combination of claim 16 wherein the sleeve and the stopper are dimensioned such that the lower end of the sleeve is disposed below the lower end of the stopper, whereby when the closure cap is removed from the vial and is placed in an upright position on a support surface the stopper does not touch the support surface.

18. An activation closure cap adapted to seal a two-compartment vial of the type having a lower first compartment and an upper second compartment, said compartments being separated from each other with a neck portion having a plug which acts as a dislodgeable seal, and a mouth portion above the second compartment, the closure cap comprising:

a resilient stopper configured to fit within and seal the mouth of the vial;

a hollow cylindrical sleeve configured to fit around the mouth of the vial and capable of being moved, within limits, axially up and down on the mouth of the vial whereby pressure can be exerted on liquid contained in the upper compartment by pushing the closure cap downward on the vial to dislodge the plug, the sleeve including means for firmly gripping the resilient stopper, whereby the closure cap including the resilient stopper can be removed from the vial, the means for firmly gripping the resilient stopper comprising a plurality of fingers disposed substantially axially within the interior of the cylindrical sleeve, an annular space being formed between the fingers and the inner wall of the cylindrical sleeve, the fingers forming a cylinder with split walls wherein the resilient stopper is held, the means for firmly gripping the resilient stopper further comprising locking means attached to the sleeve for preventing the fingers from spreading outwardly into the annular space.

19. The activation closure cap of claim 18 wherein the sleeve further includes within its interior a plurality of circumferentially spaced radially inwardly pointing tabs, and wherein each finger is attached to one of the tabs.

20. The activation closure cap of claim 19 wherein the locking means comprise a disk having a plurality of downwardly projecting spikes configured to tightly fit in the annular space between the fingers and the interior wall of the sleeve.

21. The activation closure cap of claim 20 wherein the sleeve, the tabs and the fingers comprise one unitary piece.

* * * * *